US008579159B2

(12) United States Patent
Ciavarella

(10) Patent No.: US 8,579,159 B2
(45) Date of Patent: Nov. 12, 2013

(54) SQUEEZE ACTION FOAM PUMP

(75) Inventor: Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 1228 days.

(21) Appl. No.: 12/009,536

(22) Filed: Jan. 18, 2008

(65) Prior Publication Data

US 2009/0184136 A1 Jul. 23, 2009

(51) Int. Cl.
*B67D 7/70* (2010.01)

(52) U.S. Cl.
USPC ..... 222/135; 222/190

(58) Field of Classification Search
USPC ..... 222/190, 135, 206–215, 321.7–321.8; 239/330
See application file for complete search history.

(56) References Cited

U.S. PATENT DOCUMENTS

| | | | | |
|---|---|---|---|---|
| 4,168,020 | A | 9/1979 | Benson | |
| 4,330,071 | A | 5/1982 | Ohlson | |
| 4,880,161 | A * | 11/1989 | Wright | 239/330 |
| 5,445,288 | A * | 8/1995 | Banks | 222/95 |
| 5,462,208 | A * | 10/1995 | Stahley et al. | 222/207 |
| 6,446,840 | B2 * | 9/2002 | Ophardt et al. | 222/190 |

FOREIGN PATENT DOCUMENTS

| | | |
|---|---|---|
| EP | 1147818 | 10/2001 |
| GB | 1269545 | 4/1972 |
| GB | 2301812 | 12/1996 |

OTHER PUBLICATIONS

European Patent Office Search Report Issued Jan. 7, 2011 in EP Application 09 150 800.2.

* cited by examiner

*Primary Examiner* — Lien Ngo
(74) *Attorney, Agent, or Firm* — Calfee, Halter, & Griswold LLP

(57) ABSTRACT

A foam dispenser includes a foam pump communicating with the contents of a container holding a foamable liquid. The foam pump includes a pump body, a passage extending through the pump body from an inlet to an outlet, an inlet valve including an inlet flow regulator, and an outlet valve including an outlet flow regulator. The inlet receives foamable liquid from the container. The inlet valve and outlet valve are positioned in the passage to define (a) an inlet stage, (b) an outlet stage, and (c) a transition stage. A liquid port extends through the pump body and communicates with the transition stage, and an air port extends through the pump body and communicates with the outlet stage. A liquid bellows surrounds the liquid port and an air bellows surrounds the air port. The liquid bellows contains the foamable liquid and is movable between an expanded volume and a contracted volume, and expels at least a portion of the foamable liquid to the passage through the liquid port when moved from its expanded volume to its contracted volume. The air bellows contains air and is movable between an expanded volume and a contracted volume, and expels at least a portion of the air to the passage through the air port when moved from its expanded volume to its contracted volume.

27 Claims, 2 Drawing Sheets

SQUEEZE ACTION FOAM PUMP

TECHNICAL FIELD

The invention herein resides in the art of foam pump, wherein a foamable liquid and air are combined to dispense a foam product. More particularly, the invention relates to a pump wherein air and foamable liquid are pumped through separate components into a common chamber and are extruded through a screen member to create a uniform foam.

BACKGROUND OF THE INVENTION

For many years, it has been known to dispense liquids, such as soaps, sanitizers, cleansers, disinfectants, and the like from a dispenser housing maintaining a refill unit that holds the liquid and provides the pump mechanisms for dispensing the liquid. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam, generated by the interjection of air into the liquid. Accordingly, the standard liquid pump has given way to a foam generating pump, which necessarily requires means for combining the air and liquid in such a manner as to generate the desired foam.

Typically, foam pumps include an air pump portion and a fluid pump portion—the two requiring communication to ultimately create the foam. Such pumps have been provided through various types of pump structures, as know by those familiar with the foam pump arts. This invention provides a particularly compact foam pump of a structure heretofore unknown in the art.

SUMMARY OF THE INVENTION

A foam dispenser in accordance with this invention includes a foam pump communicating with the content of a container holding a foamable liquid for dispensing. The foam pump includes a pump body, a passage extending through the pump body from an inlet to an outlet thereof, an inlet valve including an inlet flow regulator, and an outlet valve including an outlet flow regulator. The inlet receives foamable liquid from the container. The inlet valve and outlet valve are positioned in the passage such that the inlet flow regulator and the outlet flow regulator define (a) an inlet stage from the inlet to the inlet flow regulator, (b) an outlet stage from the outlet flow regulator to the outlet, and (c) a transition stage from the inlet flow regulator to the outlet flow regulator. A liquid port extends through the pump body and communicates with the transition stage, and an air port extends through the pump body and communicates with the outlet stage. A liquid bellows surrounds the liquid port and is sealed to the pump body, and an air bellows surrounds the air port and is sealed to the pump body. The liquid bellows contains the foamable liquid and is movable between an expanded volume and a contracted volume, and expels at least a portion of the foamable liquid to the passage through the liquid port when moved from its expanded volume to its contracted volume. Similarly, the air bellows contains air and is movable between an expanded volume and a contracted volume, and expels at least a portion of the air to the passage through the air port when moved from its expanded volume to its contracted volume.

DETAILED DESCRIPTION OF THE INVENTION

Figure 1:
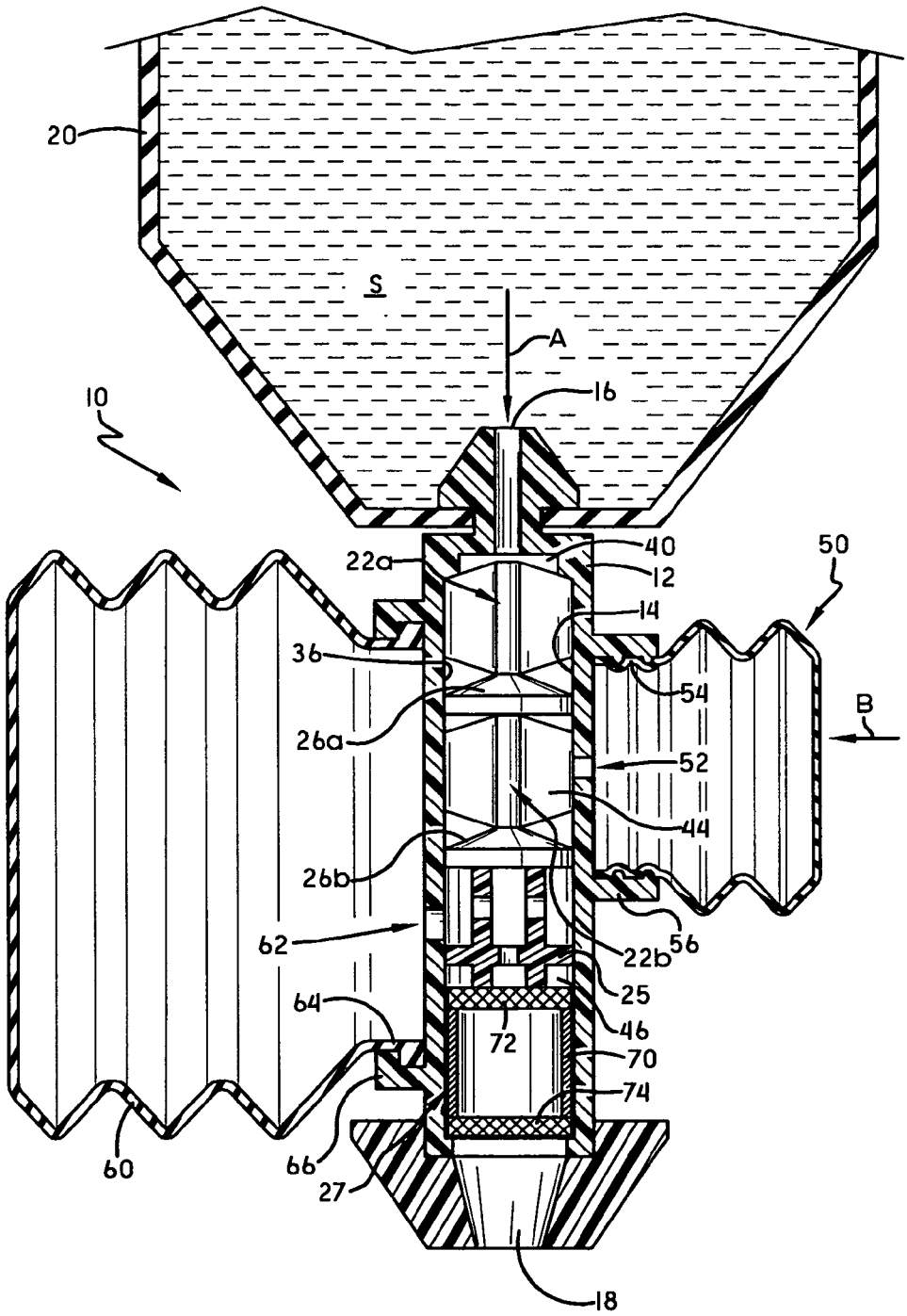
FIG. 1 is a cross sectional view of the foam pump of this invention.

In FIG. 1, the pump of this invention is shown in cross section, and designated generally by the numeral 10. The pump 10 consists of a body 12 providing a passage 14 from an inlet 16 to an outlet 18 thereof. The inlet 16 fluidly communicates with a source of liquid, for example, with a volume of soap S within a container 20. Actuation of the pump 10 serves to dispense the liquid at outlet 18. In this case, the liquid is the soap S provided by the container 20, but other liquids and other liquid sources could be employed.

Figure 3:
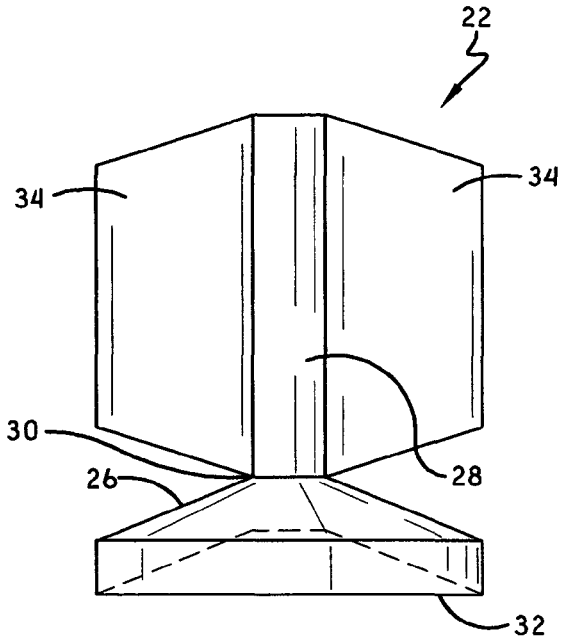
FIG. 3 is a side elevation of the valve of FIG. 2.
Figure 2:
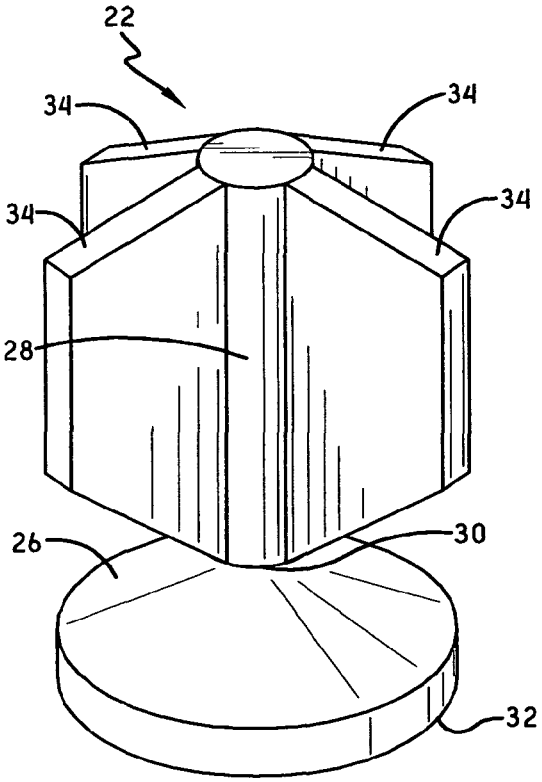
FIG. 2 is a general perspective view of a valve embodiment that is used for both an inlet valve and an outlet valve.

An inlet valve 22*a*, an outlet valve 22*b*, 25 and a mixing cartridge 27 are placed in passage 14 in series, as shown, from inlet 16 to outlet 18. The inlet valve 22*a* and outlet valve 22*b* are preferably identical to reduce the number of parts needed to construct the pump 10. In a particular embodiment, both inlet valve 22*a* and outlet valve 22*b* are shaped and function as shown in FIGS. 2 and 3 and described herein. Because this valve can be either an inlet valve or and outlet valve, no designation of "a" of "b" is used. Those designations are used, however, in FIG. 1 to help describe the functioning of the invention.

In FIGS. 2 and 3, valve 22 includes a conical wall 26 on the end of a stem 28, with the apex 30 of the conical wall 26 being secured to the stem 28 and widening as it extends away from stem 28 to base 32. Fins 34 extend radially from stem 28. Any number of fins 34 may be employed, but four fins 34 offset at 90 degrees, as shown, are sufficient. As seen in FIG. 1, the fins and the base of inlet valve 22*a* extend to contact the sidewall 36 defining passage 14. Similarly, the fins and the base of outlet valve 22*b* extend to contact the sidewall 36. The fins help to stabilize each valve 22*a*, 22*b* in passage 14, and the conical walls function to regulate flow of the soap S through the passage 14. The conical walls are flexible so they can collapse in the direction of arrow A to permit fluid to be forced therethrough, but will resist flow in the opposite direction due to contact between the conical walls and the sidewall 36.

The conical wall 26*a* of inlet valve 22*a* and the conical wall 26*b* of valve 22*b* serve to define the following stages of passage 14. An inlet stage 40 is defined between inlet 16 and the conical wall 26*a*. A transition stage 44 is defined between conical wall 26*a* and conical wall 26*b*. And an outlet stage 46 is defined between conical wall 26*b* and outlet 18. A liquid bellows 50 fluidly communicates with transition stage 44 of passage 14 through a liquid port 52, and is sealed at its base 54 to post 56 extending outwardly around the liquid port 52. The liquid bellows 50 is resilient such that it can be forced in the direction of arrow B to a contracted volume, and, from this contracted state, will spring back in the direction opposite arrow B to an expanded volume (FIG. 1). When forced to the contracted volume, any soap S within the liquid bellows 50 will be forced into transition stage 44, and the conical wall 26*a* of inlet valve 22*a* will prevent movement of any soap S in transition stage 44 in the direction of inlet 16. Thus conical wall 26*b* of outlet valve 22*b* is forced to flex to permit soap S to advance from transition stage 44 to outlet stage 46. When the liquid bellows 50 is thereafter permitted to spring back to its expanded volume, a vacuum is created in transition stage 44, and the conical wall 26*b* of outlet valve 22*b* will prevent the vacuum from drawing soap and/or air into transition stage 44 from the outlet stage 46. Instead, conical wall 26*a* of inlet valve 22*a* will flex to permit soap S to advance from inlet stage 40 into transition stage 44. Thus, when the passage 14 is full of soap S, actuation of liquid bellows 50 causes a dose of soap S to be advanced toward and out of outlet 18, and releasing of the liquid bellows 50 causes a new dose of soap S to be drawn into passage 14.

An air bellows 60 fluidly communicates with outlet stage 46 of passage 14 through air port 62, and is sealed at its base 64 to post 66 extending outwardly around air port 62. As with liquid bellows 50, the air bellows 60 is resilient and can be forced to a contracted volume and can spring back to an expanded volume. When forced to the contracted volume, any air within the air bellows 60 will be forced into outlet stage 46, and the conical wall 26*b* of outlet valve 22*b* will prevent soap S and air in outlet stage 46 from advancing in the direction of inlet 16. Instead, the air must advance toward outlet 18, through the space occupied by spacer 25 and through the mixing cartridge 27. When the air bellows 60 is thereafter permitted to spring back to its expanded volume, air is drawn into air bellows 60 through outlet 18.

The pump 10 is intended to be used by actuating, i.e., compressing, both liquid bellows 50 and air bellows 60 at the same time. From the foregoing description of each of those bellows, it should be appreciated that by simultaneously compressing both liquid bellows 50 and air bellows 60, air and soap S will be caused to mix at outlet stage 46. First, the soap S and air will form a coarse mix at a premix stage defined by spacer 25, but this coarse mix will then be forced through a mesh screen, or, as shown here, a mixing cartridge 27 to create a uniform foam for dispensing at outlet 18. The mixing cartridge 27 is sufficiently shown in FIG. 1 as tube 70 bounded on an inlet side by screen 72 and on an outlet side by screen 74. Thus, when both liquid bellows 50 and air bellows 60 are actuated at the same time, a dose of foamed soap is created at mixing cartridge 27 and dispensed at outlet 18.

The invention claimed is:

1. A foam dispenser, comprising:

a container holding a foamable liquid for dispensing;

a pump body;

a substantially straight passage extending through said pump body from an inlet to an outlet thereof, said inlet receiving foamable liquid from said container;

an inlet valve including an inlet flow regulator and an outlet valve including an outlet flow regulator, the inlet valve and outlet valve being positioned in said substantially straight passage such that said inlet flow regulator and said outlet flow regulator define: an inlet stage from said inlet to said inlet flow regulator, an outlet stage from said outlet flow regulator to said outlet, and a transition stage from said inlet flow regulator to said outlet flow regulator;

a spacer positioned in said substantially straight passage between said outlet valve and said outlet;

a liquid bellows sealed to an exterior of said pump body and defining a liquid chamber, said liquid bellows being movable between an expanded volume and a contracted volume and adapted to expel at least a portion of a liquid within the liquid chamber when moved from said expanded volume to said contracted volume;

a liquid port extending through said pump body and communicating with said transition stage and said liquid chamber;

an air bellows sealed to said exterior of said pump body and defining an air chamber, said air bellows being movable between an expanded volume and a contracted volume and adapted to expel at least a portion of a volume of air within the air chamber when moved from said expanded volume to said contracted volume; and an air port extending through said pump body and communicating with said outlet stage and said air chamber.

2. The foam dispenser of claim 1, wherein air is drawn into the air chamber through the outlet when the air bellows are moved from the contracted volume to the expanded volume.

3. The foam dispenser of claim 1, wherein the structure of the inlet valve and the outlet valve is identical such that the valves are interchangeable.

4. The foam dispenser of claim 1, wherein the inlet valve and the outlet valve are configured such that they may be selectively positioned within the passage.

5. The foam dispenser of claim 1, wherein at least one of the inlet valve and the outlet valve comprises a conical wall, a stem, and one or more fins extending radially from the stem.

6. The foam dispenser of claim 1, wherein at least one of the inlet valve and the outlet valve comprises a flexible conical wall such as to permit fluid flow in a first direction and resist fluid flow in a second direction opposite the first direction.

7. The foam dispenser of claim 1, wherein at least one of the inlet valve and the outlet valve comprises one or more fins configured to contact a sidewall of the passage to stabilize the valve within the passage.

8. The foam dispenser of claim 1, wherein at least one of the liquid bellows and the air bellows are configured to move from the contracted volume to the expanded volume without the use of a biasing mechanism.

9. The foam dispenser of claim 1, wherein both the inlet valve and the outlet valve comprise a flexible conical wall such as to permit fluid flow in a first direction and resist fluid flow in a second direction opposite the first direction and one or more fins configured to contact a sidewall of the passage to stabilize the valve within the passage.

10. The foam dispenser of claim 1, wherein the liquid bellows and the air bellows are configured such that they can be compressed substantially simultaneously from the expanded volume to the contracted volume.

11. The foam dispenser of claim 1, wherein the transition stage of the passage is substantially rigid and no portion of the transition stage is collapsible.

12. A refill unit, comprising:

a container holding a foamable liquid for dispensing;

a body portion comprising an inlet, an outlet, and a substantially straight passage extending from the inlet to the outlet, the inlet configured to receive the foamable liquid from the container;

an inlet valve positioned within the substantially straight passage between the inlet and outlet;

an outlet valve positioned within the substantially straight passage between the inlet valve and the outlet, wherein the position of the inlet valve and the outlet valve within the substantially straight passage define a first portion of the substantially straight passage between the inlet valve and the outlet valve and a second portion of the substantially straight passage between the outlet valve and the outlet;

a spacer positioned within the substantially straight passage between the outlet valve and the outlet;

a liquid pump in fluid communication with the first portion of the passage, the liquid pump configured: to draw the foamable liquid from the container, through the inlet valve, through the first portion of the passage, and into the liquid pump; and to expel the foamable liquid from the liquid pump, through the first portion of the passage, through the outlet valve, and into the second portion of the passage; and an air pump in fluid communication with the second portion of the passage, the air pump configured: to draw in air through the outlet, through the second portion of the passage, and into the air pump; and to expel the air from the air pump and into the second portion of the passage to mix with the foamable liquid expelled from the liquid pump.

13. The refill unit of claim 12, wherein the liquid pump and the air pump are sealed to the exterior of the body portion of the refill unit.

14. The refill unit of claim 12, wherein the liquid pump and the air pump are separate components configured to operate substantially simultaneously.

15. The refill unit of claim 12, wherein the structure of the inlet valve and the outlet valve is identical such that the valves are interchangeable.

16. The refill unit of claim 12, wherein at least one of the inlet valve and the outlet valve comprise a flexible conical wall such as to permit fluid flow in a first direction and resist fluid flow in a second direction opposite the first direction.

17. The refill unit of claim 12, wherein at least one of the inlet valve and the outlet valve comprise one or more fins configured to contact a sidewall of the passage to stabilize the valve within the passage.

18. The refill unit of claim 12, wherein the inlet valve and the outlet valve are one-way valves configured to permit fluid flow in a first direction and resist fluid flow in a second direction opposite the first direction.

19. A refill unit, comprising:

a container holding a foamable liquid for dispensing;

a body portion comprising an inlet, an outlet, and a substantially straight passage extending from the inlet to the outlet, the inlet configured to receive the foamable liquid from the container;

an inlet valve positioned within the substantially straight passage between the inlet and outlet;

an outlet valve interchangeable with the inlet valve and positioned within the substantially straight passage between the inlet valve and the outlet, wherein the inlet valve and the outlet valve have an identical structure;

a spacer positioned within the substantially straight passage between the outlet valve and the outlet;

a liquid pump in fluid communication with the passage, the liquid pump configured to draw the foamable liquid from the container into the liquid pump and expel the foamable liquid from the liquid pump into the passage; and an air pump in fluid communication with the passage, the air pump configured to draw in air through the outlet into the air pump and expel the air from the air pump into the passage to mix with the foamable liquid expelled from the liquid pump.

20. The foam dispenser of claim 1, wherein the inlet valve, the outlet valve, and the spacer are stacked in the passage such that the inlet valve is adjacent the outlet valve and the outlet valve is adjacent the spacer.

21. The foam dispenser of claim 1 further comprising at least one screen positioned in the passage between the spacer and the outlet.

22. The foam dispenser of claim 1 further comprising a mixing cartridge positioned in the passage between the spacer and the outlet, the mixing cartridge having a tube, an inlet screen, and an outlet screen.

23. The foam dispenser of claim 22, wherein the inlet valve, the outlet valve, the spacer, and the mixing cartridge are stacked in the passage such that the inlet valve is adjacent the outlet valve, the outlet valve is adjacent the spacer, and the spacer is adjacent the mixing cartridge.

24. A foam dispenser, comprising:

a container holding a foamable liquid for dispensing;

a pump body;

a substantially straight passage extending through said pump body from an inlet to an outlet thereof, said inlet receiving foamable liquid from said container;

an inlet valve including an inlet flow regulator and an outlet valve including an outlet flow regulator, the inlet valve and outlet valve being positioned in said passage such that said inlet flow regulator and said outlet flow regulator define: an inlet stage from said inlet to said inlet flow regulator, an outlet stage from said outlet flow regulator to said outlet, and a transition stage from said inlet flow regulator to said outlet flow regulator;

a spacer positioned in said passage between said outlet valve and said outlet;

a liquid bellows sealed to an exterior of said pump body and defining a liquid chamber, said liquid bellows being movable between an expanded volume and a contracted volume and adapted to expel at least a portion of a liquid within the liquid chamber when moved from said expanded volume to said contracted volume;

a liquid port extending through said pump body and communicating with said transition stage and said liquid chamber;

an air bellows sealed to said exterior of said pump body and defining an air chamber, said air bellows being movable between an expanded volume and a contracted volume and adapted to expel at least a portion of a volume of air within the air chamber when moved from said expanded volume to said contracted volume;

an air port extending through said pump body and communicating with said outlet stage and said air chamber; and wherein the liquid bellows and the air bellows are sealed to opposing sides of the pump body.

25. The foam dispenser of claim 1, wherein the spacer forms one or more chambers for mixing the liquid from the liquid bellows and the air from the air bellows.

26. A foam dispenser, comprising:

a container holding a foamable liquid for dispensing;

a pump body;

a substantially straight passage extending through said pump body from an inlet to an outlet thereof, said inlet receiving foamable liquid from said container;

an inlet valve including an inlet flow regulator and an outlet valve including an outlet flow regulator, the inlet valve and outlet valve being positioned in said passage such that said inlet flow regulator and said outlet flow regulator define: an inlet stage from said inlet to said inlet flow regulator, an outlet stage from said outlet flow regulator to said outlet, and a transition stage from said inlet flow regulator to said outlet flow regulator;

a spacer positioned in said passage between said outlet valve and said outlet;

a liquid bellows sealed to an exterior of said pump body and defining a liquid chamber, said liquid bellows being movable between an expanded volume and a contracted volume and adapted to expel at least a portion of a liquid within the liquid chamber when moved from said expanded volume to said contracted volume;

a liquid port extending through said pump body and communicating with said transition stage and said liquid chamber;

an air bellows sealed to said exterior of said pump body and defining an air chamber, said air bellows being movable between an expanded volume and a contracted volume and adapted to expel at least a portion of a volume of air within the air chamber when moved from said expanded volume to said contracted volume;

an air port extending through said pump body and communicating with said outlet stage and said air chamber;

wherein the spacer forms one or more chambers for mixing the liquid from the liquid bellows and the air from the air bellows; and wherein the spacer forms a first chamber and a second chamber, and wherein the first chamber is in fluid communication with the second chamber by a first orifice, and wherein the liquid and the air are mixed together in the first chamber to form a mixture, and wherein the mixture is forced through the first orifice to the second chamber.

27. The foam dispenser of claim 26 further comprising a mixing cartridge positioned in the passage between the spacer and the outlet, the mixing cartridge having a tube, an inlet screen, and an outlet screen, wherein the second chamber of the spacer is in fluid communication with the mixing cartridge by a second orifice, and wherein the mixture is forced through the second orifice to the mixing cartridge.

* * * * *